US007323818B2

(12) United States Patent
Kwon et al.

(10) Patent No.: US 7,323,818 B2
(45) Date of Patent: Jan. 29, 2008

(54) PLASMA DISPLAY PANEL

(75) Inventors: Jae-Ik Kwon, Asan (KR); Kyoung-Doo Kang, Seoul (KR); Woo-Tae Kim, Yongin (KR); Hun-Suk Yoo, Cheonan (KR); Seok-Gyun Woo, Asan (KR)

(73) Assignee: Samsung SDI Co., Ltd., Suwon-si (KR)

( * ) Notice: Subject to any disclaimer, the term of this patent is extended or adjusted under 35 U.S.C. 154(b) by 341 days.

(21) Appl. No.: 10/746,541

(22) Filed: Dec. 23, 2003

(65) Prior Publication Data

US 2004/0135509 A1 Jul. 15, 2004

(30) Foreign Application Priority Data

Dec. 27, 2002 (KR) ..... 10-2002-0084984
Jul. 22, 2003 (KR) ..... 10-2003-0050278
Jul. 30, 2003 (KR) ..... 10-2003-0052598

(51) Int. Cl.
*H01J 17/49* (2006.01)

(52) U.S. Cl. ..... 313/584; 313/582; 313/583

(58) Field of Classification Search ..... 313/581–587
See application file for complete search history.

(56) References Cited

U.S. PATENT DOCUMENTS 5,640,068 A 6/1997 Amemiya
5,661,500 A 8/1997 Shinoda et al.
5,952,782 A 9/1999 Nanto et al.
6,200,182 B1 3/2001 Nanto et al.
6,249,264 B1 * 6/2001 Sano et al. ..... 345/60
6,288,488 B1 9/2001 Amemiya
6,373,195 B1 4/2002 Whang et al.
6,376,986 B1 * 4/2002 Takagi et al. ..... 313/582
6,424,095 B1 7/2002 Hirao et al.
6,479,932 B1 11/2002 Nunomura
6,495,957 B2 * 12/2002 Kurogi et al. ..... 313/584
6,522,072 B1 2/2003 Yura et al.
6,534,914 B2 * 3/2003 Amemiya et al. ..... 313/586
6,608,441 B2 8/2003 Kunii et al.
6,639,363 B2 10/2003 Amatsuchi et al.
6,657,386 B2 12/2003 Koshio et al.

(Continued)

FOREIGN PATENT DOCUMENTS

CN 1264914 8/2000

(Continued)

*Primary Examiner*—Ashok Patel
(74) *Attorney, Agent, or Firm*—Christie, Parker & Hale, LLP

(57) ABSTRACT

A plasma display panel includes a first substrate and a second substrate opposing one another with a predetermined gap therebetween. Address electrodes are formed on the second substrate. Barrier ribs are mounted in the gap between the first substrate and the second substrate to define a plurality of discharge cells. Phosphor layers are formed in each of the discharge cells. Discharge sustain electrodes are formed in a direction intersecting the address electrodes and paired such that each of the discharge cells is in communication with a pair of the discharge sustain electrodes. Each of the discharge sustain electrodes include extension sections that extend into the discharge cells such that a pair of opposing extension sections is formed in each of the discharge cells. Distal ends of each of the extension sections extended from at least one of each pair of the bus electrodes are formed having a concave section.

22 Claims, 7 Drawing Sheets

U.S. PATENT DOCUMENTS

| | | | | |
|---|---|---|---|---|
| 6,670,754 | B1 | 12/2003 | Murai et al. | |
| 6,703,772 | B2 | 3/2004 | Hasegawa et al. | |
| 6,707,259 | B2 | 3/2004 | Nagao et al. | |
| 6,838,828 | B2 | 1/2005 | Joo et al. | |
| 6,853,136 | B2 | 2/2005 | Kim et al. | |
| 6,870,314 | B2 | 3/2005 | Kifune et al. | |
| 6,946,785 | B2 | 9/2005 | Ito et al. | |
| 2002/0021090 | A1 | 2/2002 | Sano et al. | |
| 2002/0063510 | A1* | 5/2002 | Yura et al. | 313/483 |
| 2003/0193487 | A1 | 10/2003 | Yatsuda et al. | |
| 2004/0051457 | A1 | 3/2004 | Kimura et al. | |
| 2004/0085264 | A1 | 5/2004 | Takada et al. | |
| 2004/0256989 | A1 | 12/2004 | Kim et al. | |
| 2004/0263078 | A1 | 12/2004 | Woo et al. | |
| 2005/0017637 | A1 | 1/2005 | Kang et al. | |
| 2005/9991551 | | 1/2005 | Kim et al. | |
| 2005/0029939 | A1 | 2/2005 | Woo et al. | |
| 2005/0088094 | A1 | 4/2005 | Kim et al. | |
| 2005/0212430 | A1 | 9/2005 | Ahn et al. | |

FOREIGN PATENT DOCUMENTS

| | | | |
|---|---|---|---|
| CN | 1267877 | | 9/2000 |
| CN | 1327253 | | 12/2001 |
| CN | 1337665 | | 2/2002 |
| CN | 1344005 | | 4/2002 |
| CN | 1397976 | A | 2/2003 |
| CN | 1397976 | A | 2/2003 |
| EP | 0 920 048 | A2 | 6/1999 |
| EP | 1 263 014 | A1 | 12/2002 |
| EP | 2003-303550 | | 10/2003 |
| EP | 2003-303551 | | 10/2003 |
| JP | 4-298936 | | 10/1992 |
| JP | 5-94772 | | 4/1993 |
| JP | 06-044907 | | 2/1994 |
| JP | 6-342631 | | 12/1994 |
| JP | 10-149771 | | 6/1998 |
| JP | 10-269951 | | 10/1998 |
| JP | 10-283934 | | 10/1998 |
| JP | 10-308179 | | 11/1998 |
| JP | 10-334811 | | 12/1998 |
| JP | 11-96921 | | 4/1999 |
| JP | 11-213893 | | 8/1999 |
| JP | 11-317170 | | 11/1999 |
| JP | 11-345570 | | 12/1999 |
| JP | 2000-11899 | | 1/2000 |
| JP | 2000-21313 | | 1/2000 |
| JP | 2000-42661 | | 2/2000 |
| JP | 2000-187200 | | 7/2000 |
| JP | 2000-195431 | | 7/2000 |
| JP | 2000-323045 | | 11/2000 |
| JP | 2000-357459 | | 12/2000 |
| JP | 2001-160361 | | 6/2001 |
| JP | 2001-210241 | | 8/2001 |
| JP | 2001-283734 | | 10/2001 |
| JP | 2001-345054 | | 12/2001 |
| JP | 2002-25451 | | 1/2002 |
| JP | 2002-83545 | | 3/2002 |
| JP | 2002-231146 | | 6/2002 |
| JP | 2002-190256 | | 7/2002 |
| JP | 2002-197981 | | 7/2002 |
| JP | 2002-203487 | | 7/2002 |
| JP | 2002-245943 | | 8/2002 |
| JP | 2000-260537 | | 9/2002 |
| JP | 2002-324488 | | 11/2002 |
| JP | 2002-373593 | | 12/2002 |
| JP | 2003-16944 | | 1/2003 |
| JP | 2003-31130 | | 1/2003 |
| JP | 2003-68212 | | 3/2003 |
| JP | 2003-68215 | | 3/2003 |
| JP | 2003-132805 | | 5/2003 |
| JP | 2003-157773 | | 5/2003 |
| JP | 2004-164885 | | 6/2004 |
| KR | 1998-030878 | | 8/1998 |
| KR | 1999-0062632 | | 7/1999 |
| KR | 1999-0065408 | | 8/1999 |
| KR | 2001-0016651 | | 3/2001 |
| KR | 2001-0062222 | | 7/2001 |
| KR | 2001-0093724 | | 10/2001 |
| KR | 2002-0036012 | | 5/2002 |
| KR | 2002-0055807 | | 7/2002 |
| KR | 1020030033658 | A | 5/2003 |
| KR | 2003-0044667 | | 6/2003 |
| KR | 2003-0061079 | | 7/2003 |
| KR | 10-2004-0032508 | | 4/2004 |
| WO | WO99/50877 | | 10/1999 |
| WO | WO00/46832 | | 8/2000 |

* cited by examiner

PLASMA DISPLAY PANEL

CROSS REFERENCE TO RELATED APPLICATIONS

This application claims priority to and the benefit of Korea Patent Application No. 2002-0084984 filed on Dec. 27, 2002, Korea Patent Application No. 2003-0050278 filed on Jul. 22, 2003 and Korea Patent Application No. 2003-0052598 filed on Jul. 30, 2003, all filed in the Korean Intellectual Property Office, the entire contents of which are each incorporated herein by reference.

BACKGROUND OF THE INVENTION (a) Field of the Invention

The present invention relates to a plasma display panel, and more particularly, to a surface discharge-type plasma display panel having an electrode structure in which a pair of discharge sustain electrodes that generate display discharge is mounted corresponding to each discharge cell between two substrates.

(b) Description of the Related Art

A plasma display panel (PDP) is typically a display device in which ultraviolet rays generated by the discharge of gas excite phosphors to realize predetermined images. As a result of the high resolution possible with PDPs (even with large screen sizes), many believe that they will become a major, next generation flat panel display configuration.

In a conventional PDP, with reference to FIG. 5, address electrodes 51 are formed along one direction (direction X in the drawing) on second substrate 50. Dielectric layer 53 is formed over an entire surface of second substrate 50 on which address electrodes 51 are formed such that dielectric layer 53 covers address electrodes 51. Barrier ribs 55 are formed on dielectric layer 53 in a line pattern and at locations between address electrodes 51. Red, green, and blue phosphor layers 57 are formed between barrier ribs 55 are.

First substrate 60 is provided opposing second substrate 50. Discharge sustain electrodes 64 are formed on a surface of first substrate 60 facing second substrate 50. Each of discharge sustain electrodes 64 includes a pair of transparent electrodes 62 and a pair of bus electrodes 63. Transparent electrodes 62 and bus electrodes 63 are arranged in a direction substantially perpendicular to address electrodes 51 of first substrate 60 (i.e., along direction Y). Dielectric layer 66 is formed over an entire surface of first substrate 60 on which discharge sustain electrodes 64 are formed such that dielectric layer 66 covers discharge sustain electrodes 64. MgO protection layer 68 is formed covering dielectric layer 66.

Areas between where address electrodes 51 of second substrate 50 and discharge sustain electrodes 64 of first substrate 60 intersect become areas that form discharge cells.

An address voltage Va is applied between address electrodes 51 and discharge sustain electrodes 64 to perform address discharge. Then a sustain voltage Vs is applied between a pair of discharge sustain electrodes 64 to perform sustain discharge. Ultraviolet rays generated at this time excite corresponding phosphor layers 57 such that visible light is emitted through first substrate 60, which is transparent, to realize the display of images.

Discharge sustain electrodes 64 will be described in greater detail with reference now to FIG. 6. Transparent electrodes 62 are formed substantially perpendicular to the direction of barrier ribs 55 as described above. Transparent electrodes 62 comprising each pair that form discharge sustain electrodes 64 are provided at a predetermined distance from each other. That is, each pair of transparent electrodes 62 occupies a predetermined space along direction X. Also, a predetermined spacing is used between adjacent pairs of transparent electrodes 62. Bus electrodes 63 enhance electric conductivity and are formed such that one of bus electrodes 63 is provided along a long edge of each of transparent electrodes 62 to thereby complete the formation of discharge sustain electrodes 64.

In an alternative conventional configuration, with reference to FIG. 7, discharge sustain electrodes 74 are formed including a pair of bus electrodes 73 provided substantially perpendicular to barrier ribs 55 (along direction Y), and transparent electrodes 72 formed extending from bus electrodes 73 to be positioned within each discharge cell. Transparent electrodes 72 are formed in a T-shape with the base of the "T" connected to bus electrodes 73 as shown in the figure.

However, with respect to the structure shown in FIGS. 5 and 6 in which each pair of transparent electrodes 62 occupies a predetermined space along direction X, since a uniform field is not formed over the entire surface of transparent electrodes 62 when a voltage is applied to discharge sustain electrodes 64 to effect discharge, many unnecessary areas of transparent electrodes 62 result which contribute little to discharge. In addition to reducing discharge efficiency within the discharge cells, these areas reduce brightness by screening a significant region of the discharge cells.

Further, when forming transparent electrodes 72 in a T-shape as shown in FIG. 7, a situation results where discharge is concentrated at corner areas of transparent electrodes 72. This prevents the uniform spreading of discharge within the discharge cells.

SUMMARY OF THE INVENTION

In accordance with the present invention a plasma display panel is provided in which the distribution of discharge within discharge cells is analyzed to optimize the formation of discharge sustain electrodes such that a discharge initialization voltage is reduced and discharge efficiency is improved.

In one embodiment, the present invention involves a plasma display panel which includes a first substrate and a second substrate opposing one another with a predetermined gap therebetween. Address electrodes are formed on the second substrate. Barrier ribs are mounted in the gap between the first substrate and the second substrate to define a plurality of discharge cells. Phosphor layers are formed in each of the discharge cells. Discharge sustain electrodes are formed in a direction intersecting the address electrodes and paired such that each of the discharge cells is in communication with a pair of the discharge sustain electrodes. Each of the discharge sustain electrodes include extension sections that extend into the discharge cells such that a pair of opposing extension sections is formed in each of the discharge cells. Distal ends of each of the extension sections extended from at least one of each pair of the discharge sustain electrodes are formed having a concave section.

In an exemplary embodiment, the concave section may be formed in substantially a center of the distal ends of the extension sections, and the concave section of the extension sections is connected to areas at its peripheries through curved, smoothly rounded sections.

Convex sections may be formed to both sides of the concave section.

Each of the extension sections of the discharge sustain electrodes may be formed such that at least one long side is inwardly formed away from an adjacent barrier rib for a predetermined length of the extension sections. Also, each of the extension sections of the discharge sustain electrodes is formed such that a width in the direction intersecting the address electrodes is decreased as a distance from a center of the discharge cells is increased.

The discharge sustain electrodes may include bus electrodes formed in a direction intersecting the address electrodes and paired such that each of the discharge cells is in communication with a pair of the bus electrodes, and extension electrodes formed extended from the bus electrode within each of the discharge cells such that a pair of opposing extension electrodes is formed in each of the discharge cells. Distal ends of each of the extension electrodes are extended from at least one of each pair of the bus electrodes and are formed having a concave section.

The extension electrodes may be transparent. Also, each of the extension electrodes of the discharge sustain electrodes is formed such that a width in the direction intersecting the address electrodes is decreased as a distance from a center of the discharge cells is increased.

In a further embodiment, a plasma display panel includes a first substrate and a second substrate opposing one another with a predetermined gap therebetween. Address electrodes are formed on the second substrate. Barrier ribs are mounted in the gap between the first substrate and the second substrate to define a plurality of discharge cells. Phosphor layers formed in each of the discharge cells. Discharge sustain electrodes are formed in a direction intersecting the address electrodes such that each of the discharge cells is in communication with a pair of the discharge sustain electrodes, each of the discharge sustain electrodes including a discharge sustain electrode extension section that extends into the discharge cell such that a pair of opposing discharge sustain electrode extension sections is formed in each of the discharge cells, a distal end of each discharge sustain electrode extension section having an enlarged discharge sustain electrode extension section with an enlarged section width being larger than a width of the discharge sustain electrode extension section distal from a communicating pair of discharge sustain electrodes of the discharge cell. Among each pair of discharge sustain electrodes corresponding to a discharge cell, one of each pair is a scanning electrode that effects address discharge between address electrodes in a scan interval and an other of each pair is common electrode that effects display discharge between the common electrode and corresponding scanning electrode during a discharge sustain interval. Each of the address electrodes have an enlarged address electrode section at areas corresponding to the enlarged discharge sustain electrode extension section of an opposing scanning electrodes.

In a still further embodiment, plasma display panel screen brightness during sustain discharge of a plasma display panel is enhanced. The plasma display panel has a first substrate and a second substrate opposing one another with a predetermined gap therebetween. Address electrodes are formed on the second substrate. Barrier ribs are mounted in the predetermined gap between the first substrate and the second substrate to define a plurality of discharge cells. The discharge cells have a discharge cell gas excited by an initiator discharge voltage. Phosphor layers are formed in each of the discharge cells. Discharge sustain electrodes are formed in a direction intersecting the address electrodes such that each of the discharge cells is in communication with a pair of the discharge sustain electrodes. Each of the discharge sustain electrodes include a discharge sustain electrode extension section that extends into the discharge cell such that a pair of opposing discharge sustain electrode extension sections is formed in each of the discharge cells with a gap between distal ends of the opposing discharge electrode extension sections. The initiator discharge voltage is established as a function of the size of the gap and an amount of Xenon gas content of the discharge cell gas.

DETAILED DESCRIPTION

Figure 1:
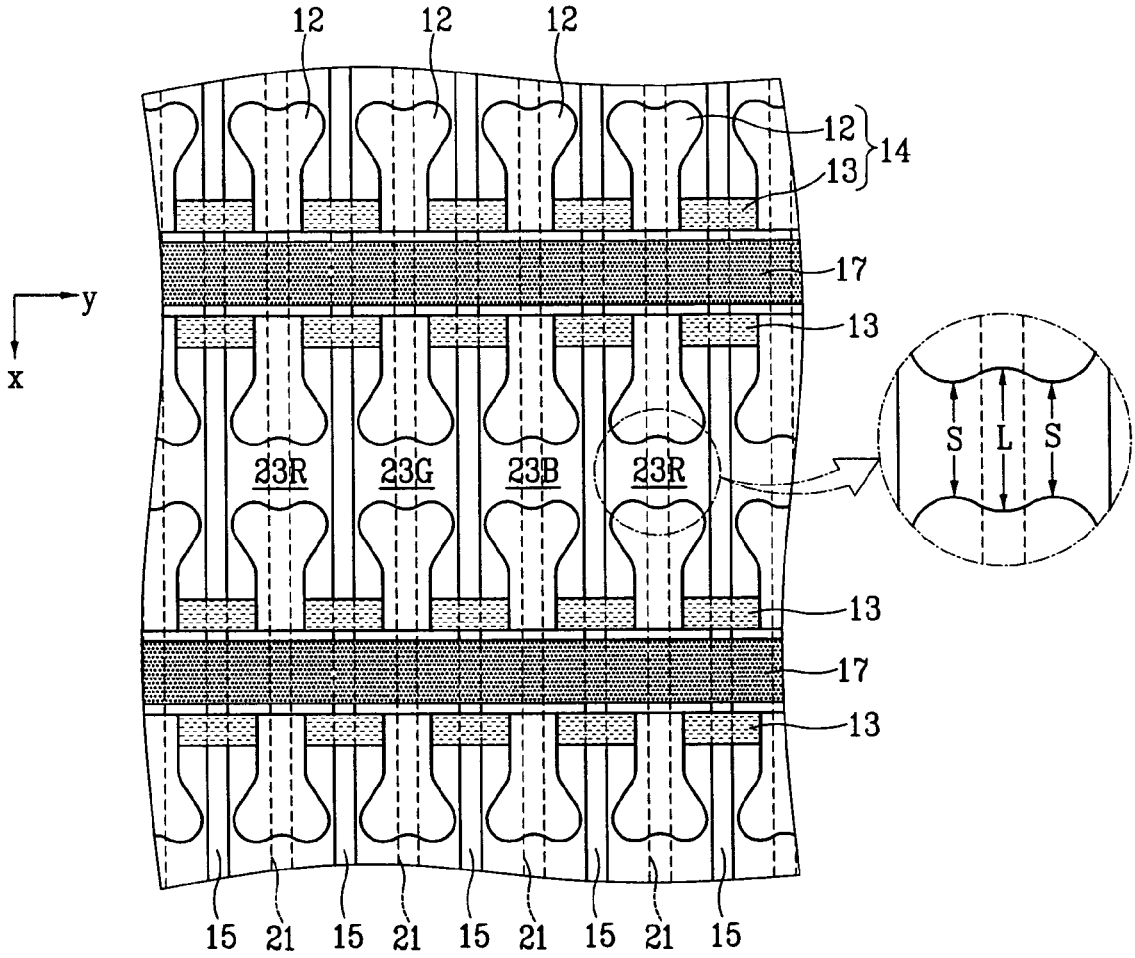
FIG. 1 is a partial plan view of a plasma display panel according to a first embodiment of the present invention.

Referring first to FIG. 1, in the plasma display panel (PDP) according to the first embodiment of the present invention, a plurality of address electrodes 21 is formed on a second substrate (not shown) along one direction (direction Y) of the same, and a plurality of discharge sustain electrodes 14 is formed on a first substrate (not shown) along a direction (direction X) substantially perpendicular to address electrodes 21.

Figure 5:
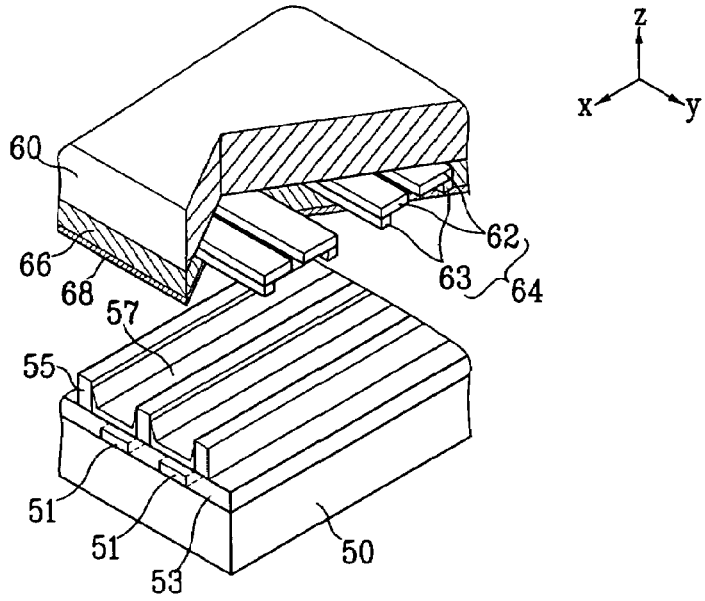
FIG. 5 (Prior Art)
FIG. 5 is a partial cutaway perspective view of a conventional plasma display panel.
Figure 6:
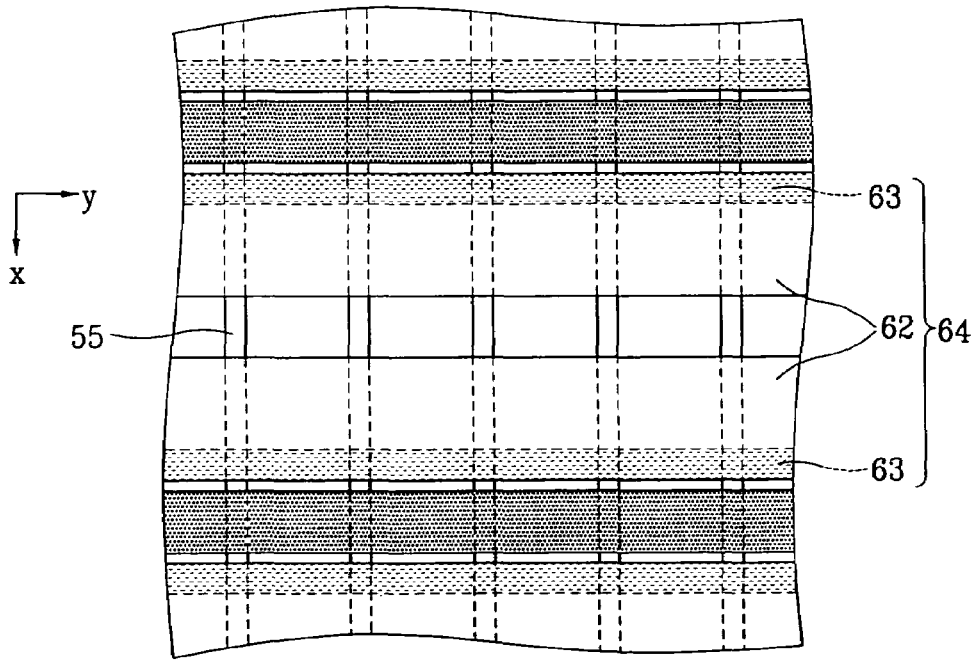
FIG. 6 (Prior Art)
FIG. 6 is a partial plan view of the plasma display panel of FIG. 5.
Figure 7:
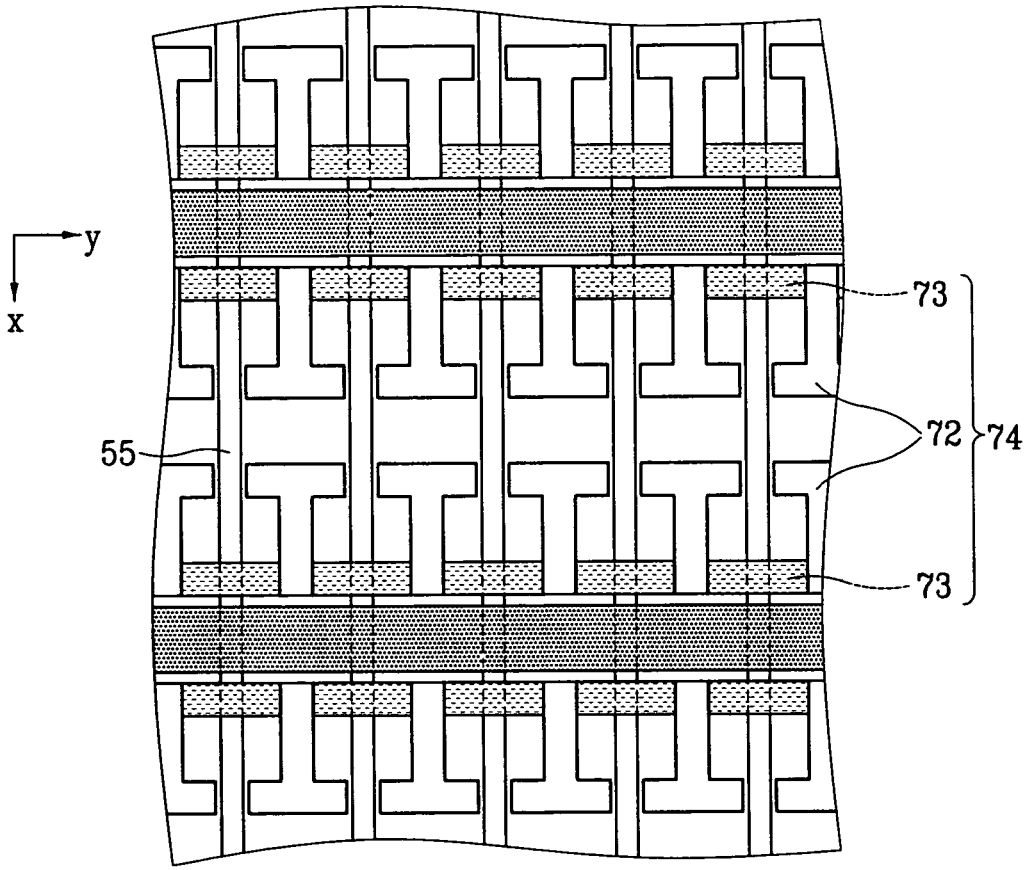
FIG.7 (Prior Art)
FIG. 7 is a partial plan view of a conventional plasma display panel employing a T-shape discharge electrode configuration.

A plurality of barrier ribs 15 is formed in a space between the second substrate and the first substrate. One the barrier ribs 15 is formed between each adjacent pair of address electrodes 21 and is uniformly aligned with the same in the same manner as shown in FIG. 5. Barrier ribs 15 define discharge cells 23R, 23G, and 23B, which are needed for plasma discharge. In the first embodiment, although barrier ribs 15 are described as being formed in a stripe pattern, the present invention is not limited to such a configuration. For example, it is possible in the present invention to use a closed barrier rib structure including barrier rib members that are aligned with address electrodes 21 and barrier rib members that intersect address electrodes 21 to thereby define discharge cells 23R, 23G, and 23B.

Discharge sustain electrodes 14 include extension electrodes 12 and bus electrodes 13. Extension electrodes 12 act to effect plasma discharge within discharge cells 23R, 23G, and 23B, and are preferably realized using transparent ITO (Indium Tin Oxide) in order to ensure brightness levels. Bus electrodes 13 compensate for the high resistance of extension electrodes 12 (i.e., the high resistance of ITO) to enhance electric conductivity. Bus electrodes 13 are therefore preferably made of a metal material.

Bus electrodes 13 are formed substantially in parallel along direction Y (i.e., in a line pattern) and in such a manner that for each of discharge cells 23R, 23G, and 23B, two of bus electrodes 13 are provided at substantially opposite ends thereof. A plurality of extension electrodes 12 is protruded from each of bus electrodes 13 and at areas within discharge cells 23R, 23G, and 23B. As a result, for each of discharge cells 23R, 23G, and 23B, an opposing pair of extension electrodes 12 is positioned therein. Extension electrodes 12 are formed also such that distal ends of opposing pairs within discharge cells 23R, 23G, and 23B are provided at a predetermined distance.

Figure 2:
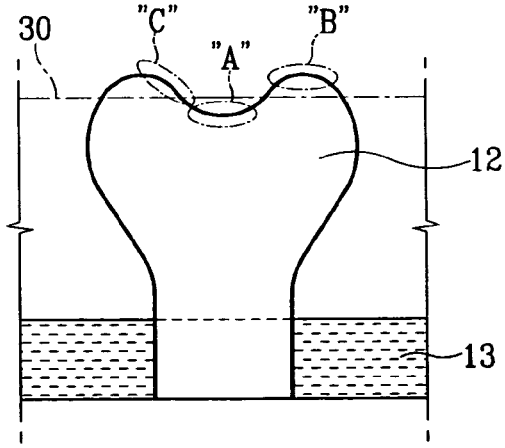
FIG. 2 is an enlarged plan view of a portion of a transparent electrode used in the plasma display panel of FIG. 1.

With reference to FIG. 2, a distal end of each of extension electrodes 12 is formed including concave section A at a center of the distal end, and convex sections B formed extending from opposite sides of concave section A. Therefore, for each pair of opposing extension electrodes 12 within each of discharge cells 23R, 23G, and 23B, long gap L, as seen in FIG. 1, is formed between opposing concave sections A, and relatively short gap S is formed between each of opposing convex sections B. This configuration results in the main discharge occurring initially where short gaps S are formed, after which discharge spreads to long gap L then to the remainder of discharge cells 23R, 23G, and 23B.

Concave sections A of extension electrodes 12 act to concentrate discharge at centers of discharge cells 23R, 23G, and 23B to thereby effect stable discharge. Convex sections B reduce the distance between distal ends of opposing extension electrodes 12 (over the prior art) so that the voltage needed for discharge is minimized. This advantage is realized by convex sections B while not significantly reducing the aperture ratio.

In an exemplary embodiment concave sections A and convex sections B of extension electrodes 12 are provided in a curved configuration, that is, lacking sharp angles. This is realized by the formation of connecting sections C between concave sections A and convex sections B, as seen in FIG. 2. In particular, for each of extension electrodes 12, connecting sections C between concave section A and convex sections B are formed with a reducing slope as concave section A is approached. Using the natural spread of discharge, connecting sections C act to induce the discharge toward the long gaps from where it is started in the short gaps.

In more detail, there is a non-linear relation between discharge and the externally applied voltage. For example, if a discharge initialization voltage is 200V, discharge does not occur until 200V is reached and will not occur if a lesser voltage of, say, 199V is reached. However, discharge characteristics are such that once discharge occurs and is repeated (i.e., diffused), discharge is spread to peripheries by geometric progression. The main discharge is induced into the long gaps through such spreading.

The formation of concave sections A and convex sections. B of extension electrodes 12 is such that for each pair of bus electrodes 13 provided for each row of discharge cells 23R, 23G, and 23B along direction Y, concave sections A and convex sections B may be formed at the distal ends of extension electrodes 12 corresponding to one of bus electrodes 13 or to both of bus electrodes 13 as described above.

Further, in the first embodiment, extension electrodes 12 of discharge sustain electrodes 14 are formed such that a distance to adjacent barrier ribs 15 is initially decreased in a direction toward proximal ends of extension electrodes 12. Stated differently, the formation of extension electrodes 12 outside concave regions A and convex regions B is such that as a distance from the center of discharge cells 23R, 23G, and 23B is increased, the distance between extension electrodes 12 and adjacent barrier ribs 15 in the direction bus electrodes 13 are formed (direction Y) is initially decreased. This is continued for a predetermined length of extension electrodes 12 along the direction barrier ribs 15 are formed (direction X), after which a predetermined width of extension electrodes 12 is maintained for the remainder of its length, such that the distance to adjacent barrier ribs 15 is increased. Since the proximal ends of extension electrodes 12 contribute little to the generation of discharge, such a configuration improves discharge efficiency. Also, a high aperture ratio is ensured by having the proximal ends formed to a smaller width than the distal ends.

Black stripe 17 may be formed between each of non-paired adjacent discharge sustain electrodes 14 to improve contrast.

Figure 3:
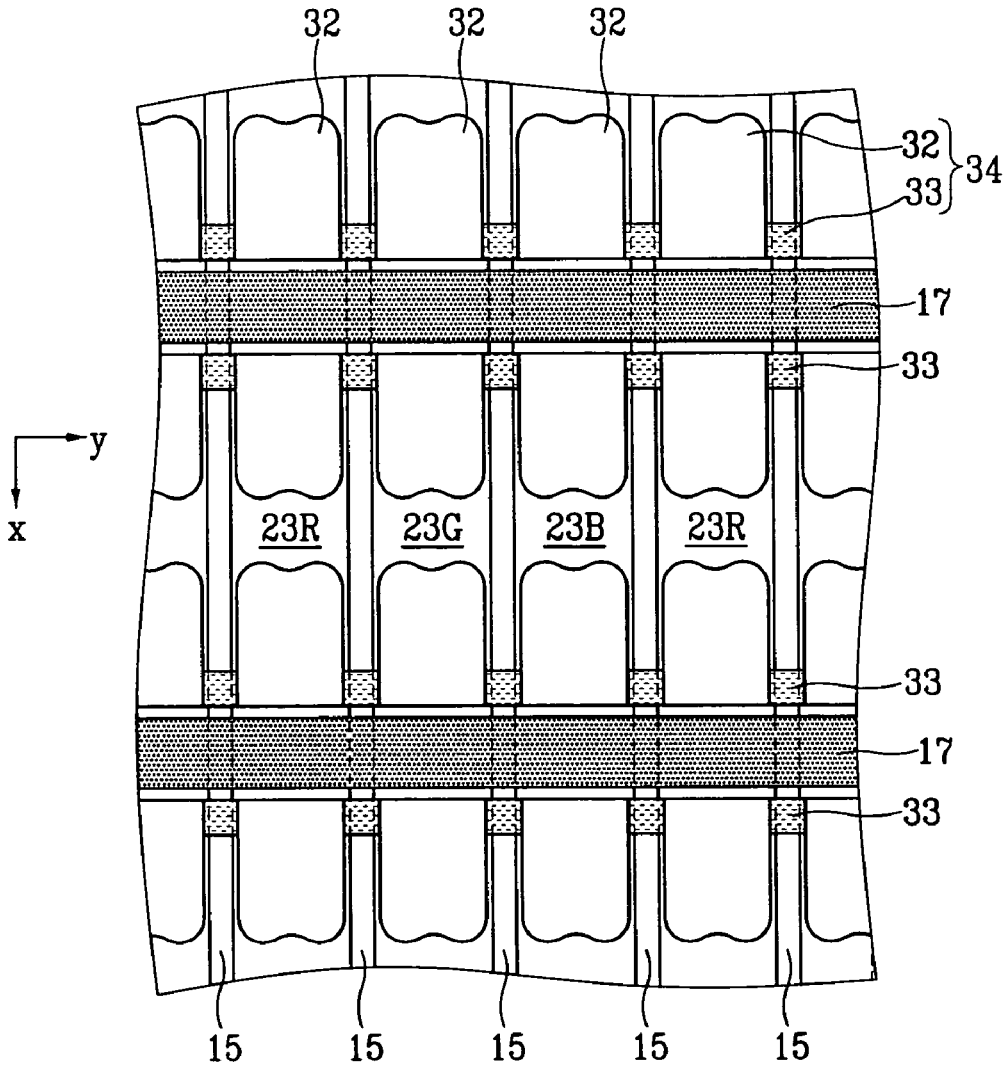
FIG. 3 is a partial plan view of a plasma display panel according to a second embodiment of the present invention.

Referring now to FIG. 3, a partial plan view of a plasma display panel according to a second embodiment of the present invention is shown.

The PDP of the second embodiment has the same basic structure as that of the first embodiment, and only extension electrodes 32 of discharge sustain electrodes 34 are formed differently. In particular, while furthermost parts of distal ends of extension electrodes 32 are formed as in the first embodiment, a width of extension electrodes 32 in a direction bus electrodes 33 are formed is maintained throughout a length of extension electrodes 32 in the direction barrier ribs 15 are formed.

Figure 4:
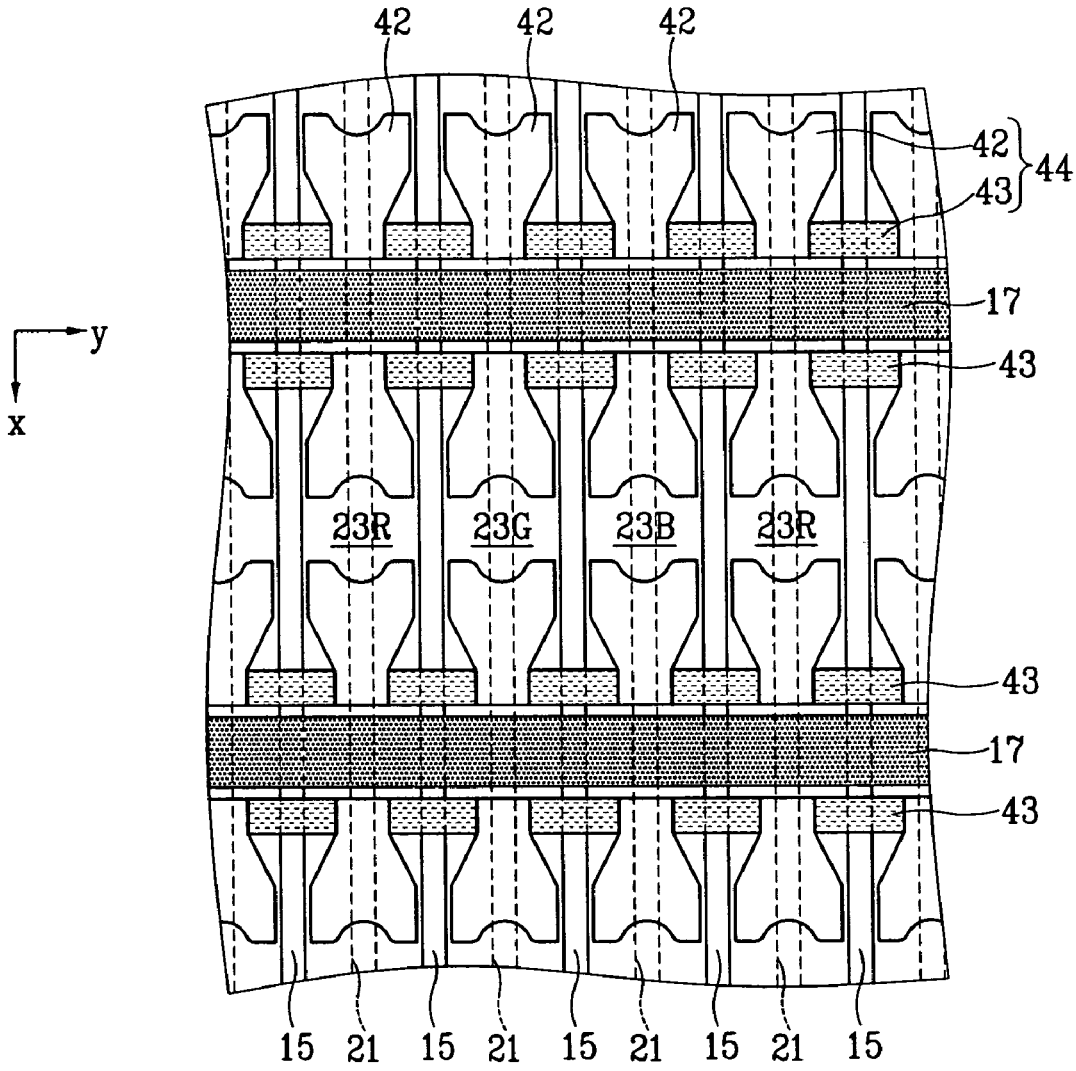
FIG. 4 is a partial plan view of a plasma display panel according to a third embodiment of the present invention.

Referring to FIG. 4, a partial plan view of a plasma display panel according to a third embodiment of the present invention is shown.

The PDP of the third embodiment has the same basic structure as that of the first embodiment, and only extension electrodes 42 of discharge sustain electrodes 44 are formed differently. In particular, centers of distal ends of extension electrodes 42 include only concave sections and no convex sections are formed as in the first embodiment. Also, starting from the distal ends of extension electrodes 42 and in a direction toward proximal ends of the same, outer long edges of extension electrodes 42 are formed with a straight section of a predetermined width in a direction bus electrodes 43 are formed. This is continued for a predetermined length of extension electrodes 42, then the long edges are slanted inwardly to decrease the width of extension electrodes 42 until reaching approximately the point at which extension electrodes 42 are connected to bus electrodes 43. At this point, the long edges of extension electrodes 42 are straightened to be substantially parallel to barrier ribs 15, and this configuration is continued for the remainder of extension electrodes 42.

In the PDP of the present invention described above, the formation of the discharge sustain electrodes is optimized to minimize unneeded areas of the electrodes, thereby resulting in limiting the discharge current and improving discharge efficiency.

Further, the aperture ratio is increased by minimizing the size of the discharge sustain electrodes, which have 95% transmissivity. That is, even with the reduction in the area of the discharge sustain electrodes, a brightness level that is identical to or higher than the prior art is realized. This allows for an improvement in the aperture ratio and a reduction in the amount of material used to form the discharge sustain electrodes.

Figure 8:
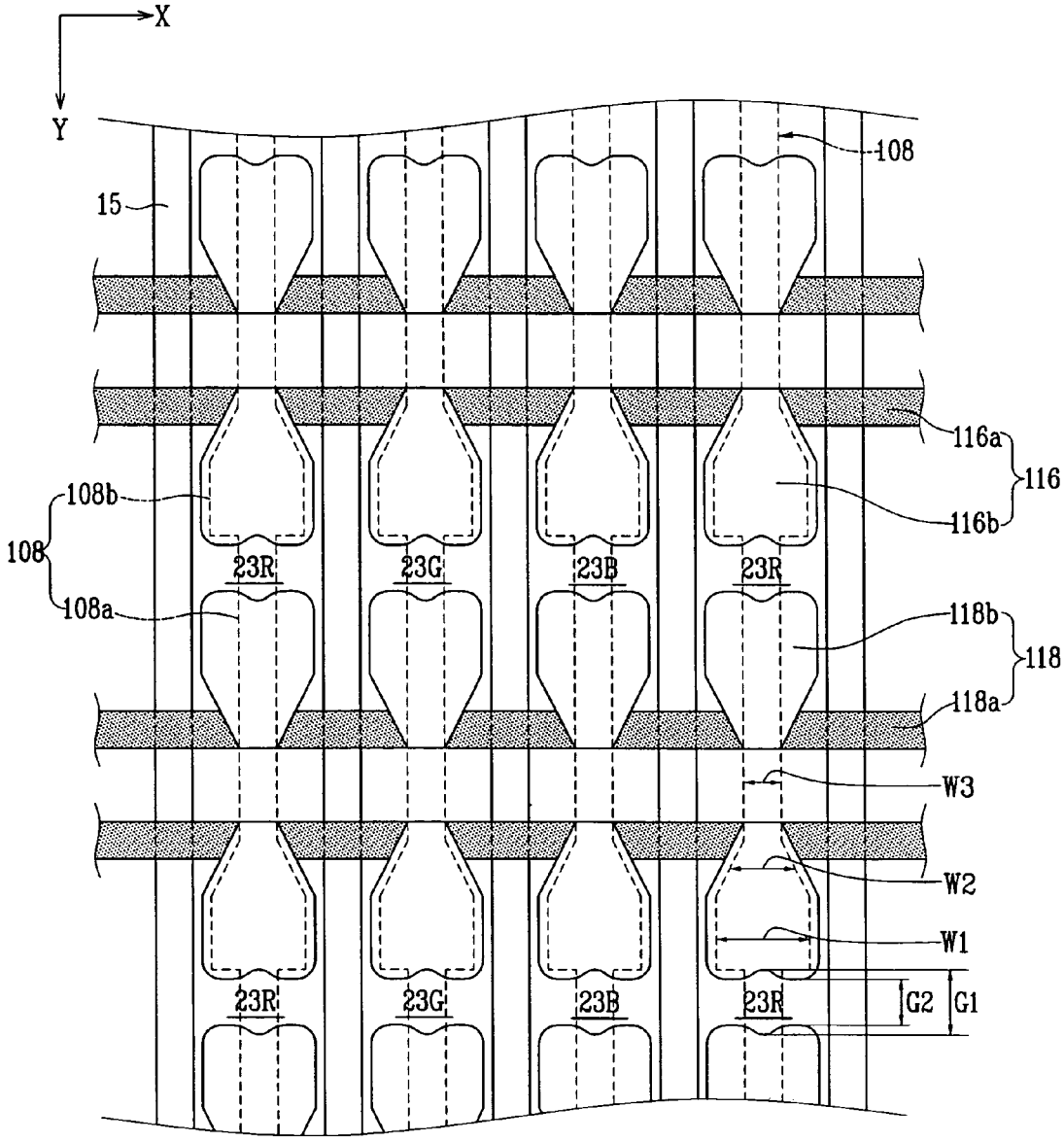
FIG. 8 is a partial plan view of a plasma display panel according to a fourth embodiment of the present invention.

With reference to FIG. 8, showing a fourth embodiment of the present invention, among a pair of discharge sustain electrodes 116 and 118 corresponding to each of discharge cells 23R, 23G, and 23B, one is scanning electrode 116 that effects address discharge between address electrodes in a scan interval, and the other is common electrode 118 that effects display discharge between itself and corresponding scanning electrode 116 during a discharge sustain interval.

Address electrodes 108 have enlarged section 108*b* corresponding to the formation of protrusion 116*b* of scanning electrodes 116 and at areas opposing scanning electrodes 116. This allows scanning electrodes 116 to be formed having an increased area.

That is, each of address electrodes 108 includes linear section 108*a* that extends along a longitudinal direction (direction Y), and enlarged sections 108*b* that are expanded in a direction of the width of the PDP (direction X). Enlarged sections 108*b* are expanded corresponding roughly to a shape of protrusions 116*b* of scanning electrodes 116.

In more detail, a portion of each of enlarged sections 108*b* of address electrodes 108 corresponding to a distal end portion of each of protrusions 116*b* of scanning electrodes 116 is substantially quadrilateral, having width W1. Further, a portion of each of enlarged sections 108*b* of address electrodes 108 corresponding to a proximal end portion of each of protrusions 116*b* of scanning electrodes 116 has width W2 that decreases as corresponding bus electrode 116*a* of scanning electrode 116 is approached. For reference, width W3 of linear portion 108*a* of one of address electrodes 108 is shown. In this exemplary embodiment, the following inequalities are satisfied: W1>W2>W3.

With the formation of enlarged sections 108*b* of address electrodes 108 at areas corresponding to the formation of scanning electrodes 116 as described above, address discharge between address electrodes 108 and scanning electrodes 116 may be enhanced, and interference of common electrodes 118 during address discharge may be reduced. Therefore, address discharge is stabilized and mis-discharge is prevented.

Referring back to FIG. 1 as a representative embodiment, discharge sustain electrodes have a pair of opposing long gaps L and short gaps S such that a discharge initiation voltage Vf is reduced. Therefore, the amount of Xenon (Xe) gas contained in the discharge gas may be increased with an increase in the discharge initiation voltage Vf.

In an exemplary embodiment, the discharge gas contains 10% or more, preferably between 10 and 60%, of Xe. A stronger emission of ultraviolet rays is possible during sustain discharge as a result of the increased amount of Xe such that screen brightness is enhanced.

The relation between the amount of Xe contained in the discharge gas and the discharge gap between opposing protrusions is explained with reference to Table 1 and FIG. 9. Among the different discharge gaps, the long gaps are referred to as first discharge gaps G1, and the short gaps are referred to as second discharge gaps G2.

If A is the sum of the size of first discharge gaps G1 and the size of second discharge gaps G2, Table 1 shows the A values obtained through experimentation, that is, the A values in which driving is possible by a suitable discharge initiation voltage Vf according to variations in the amount of Xe in discharge gas. Suitable PDP driving was not possible when the discharge gas contained 60% or more of Xe.

In table 1, F(A+Xe) shows the addition of the A values (with units of micrometers ignored) with the amount of Xe in the discharge gas (with the percentage of this amount ignored). Further, the discharge efficiencies, which are measured according to the amount of Xe in the discharge gas, are relative values based on a value of 1 for a 5% amount of Xe in discharge gas.

TABLE 1

| Xe amount in discharge gas (%) | Suitable A values according to Xe amount (μm) | F(A + Xe) | Discharge efficiency |
|---|---|---|---|
| 5 | 180–210 | 185–215 | 1 |
| 7 | 170–210 | 177–217 | 1.05 |
| 10 | 165–210 | 175–220 | 1.35 |
| 15 | 155–195 | 170–210 | 1.45 |
| 20 | 147–190 | 167–210 | 1.57 |
| 25 | 143–187 | 168–213 | 1.76 |
| 30 | 137–187 | 167–217 | 2.0 |
| 35 | 135–185 | 170–220 | 2.26 |
| 40 | 133–185 | 173–225 | 2.41 |
| 50 | 125–180 | 175–230 | 2.89 |
| 55 | 120–177 | 175–232 | 3.12 |
| 60 | 110–170 | 170–240 | 3.48 |

It is evident from Table 1 that by increasing the amount of Xe in discharge gas from 5% to 60%, when the size of first and second discharge gaps G1 and G2 are made small, driving at a suitable discharge initiation voltage Vf is possible and discharge efficiency is improved. In particular, compared to when the amount of Xe in discharge gas is 5%, discharge efficiency significantly improved when the amount of Xe is 10% or more. Accordingly, in the PDP of this exemplary embodiment, in addition to the above formation of the protrusions of the discharge sustain electrodes, an amount of 10% or more (to a maximum of 60%) of Xe is contained in discharge gas to thereby improve discharge efficiency.

Figure 9:
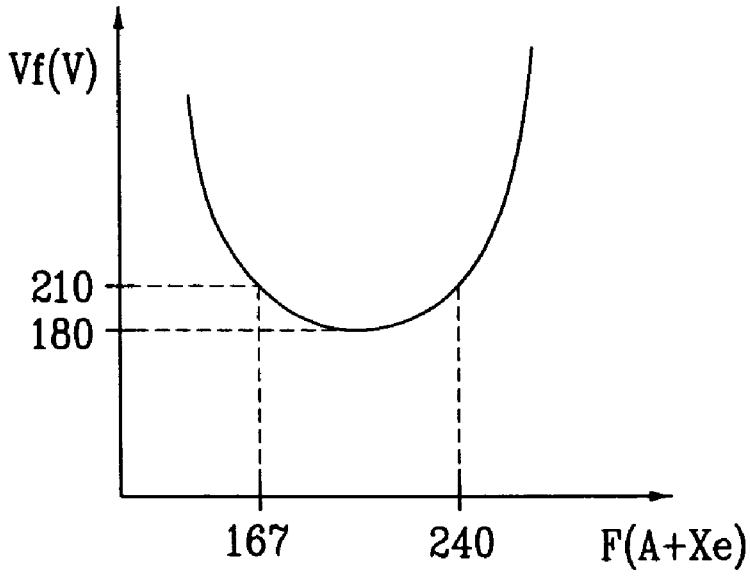
FIG. 9 is a graph showing variations in the discharge initiation voltage as a function of discharge gaps and the amount of Xenon gas in the discharge gas.

FIG. 9 is a graph showing variations in the discharge initiation voltage Vf as a function of F(A+Xe).

With reference to FIG. 9, driving is performed in a range of 180 to 210V, which is considered a suitable discharge initiation voltage Vf in the PDP industry, when the F(A+Xe) value is in the range of 167 to 240 and while the amount of Xe in the discharge gas is between 10 and 60%. Accordingly, the PDP according to this exemplary embodiment realizes a discharge sustain electrode configuration that includes 10 to 60% Xe in the discharge gas and a value of F(A+Xe) between 167 and 240.

Although embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A plasma display panel, comprising:

a first substrate and a second substrate opposing one another with a predetermined gap therebetween;

address electrodes formed on the second substrate;

barrier ribs mounted in the gap between the first substrate and the second substrate to define a plurality of discharge cells;

a phosphor layer formed in each of the discharge cells; and discharge sustain electrodes formed in a direction intersecting the address electrodes such that each of the discharge cells is in communication with a pair of the discharge sustain electrodes, each of the discharge sustain electrodes including extension sections that extend into the discharge cells such that a pair of opposing extension sections is formed in each of the discharge cells, wherein distal ends of each of the extension sections extended from at least one of each pair of the discharge sustain electrodes are formed having a concave section.

2. The plasma display panel of claim 1, wherein the concave section is formed in substantially a center of the distal ends of the extension sections.

3. The plasma display panel of claim 1, wherein convex sections are formed at both sides of the concave section.

4. The plasma display panel of claim 1, wherein the concave section of the extension sections is connected to distal end periphery areas by curved, smoothly rounded sections.

5. The plasma display panel of claim 1, wherein each of the extension sections of the discharge sustain electrodes is formed such that at least one long side is inwardly formed away from an adjacent barrier rib for a predetermined length of the extension sections.

6. The plasma display panel of claim 1, wherein each of the extension sections of the discharge sustain electrodes is formed such that a width in the direction intersecting the address electrodes is decreased as a distance from a center of the discharge cells is increased.

7. A plasma display panel, comprising:

a first substrate and a second substrate opposing one another with a predetermined gap therebetween;

address electrodes formed on the second substrate;

barrier ribs mounted in the gap between the first substrate and the second substrate to define a plurality of discharge cells;

phosphor layers formed in each of the discharge cells; and discharge sustain electrodes including bus electrodes formed in a direction intersecting the address electrodes such that each of the discharge cells is in communication with a pair of the bus electrodes, and extension electrodes formed extended from the bus electrode within each of the discharge cells such that a pair of opposing extension electrodes is formed in each of the discharge cells, wherein distal ends of each of the extension electrodes extended from at least one of each pair of the bus electrodes are formed having a concave section.

8. The plasma display panel of claim 7, wherein the concave section is formed in substantially a center of the distal ends of the extension electrodes.

9. The plasma display panel of claim 7, wherein convex sections are formed at both sides of the concave section.

10. The plasma display panel of claim 7, wherein the concave section of the extension electrodes is connected to distal end periphery areas by curved, smoothly rounded sections.

11. The plasma display panel of claim 7, wherein each of the extension electrodes of the discharge sustain electrodes is formed such that a width in the direction intersecting the address electrodes is decreased as a distance from a center of the discharge cells is increased.

12. The plasma display panel of claim 7, wherein the extension electrodes are transparent.

13. A plasma display panel, comprising:

a first substrate and a second substrate opposing one another with a predetermined gap therebetween;

address electrodes formed on the second substrate;

barrier ribs mounted in the gap between the first substrate and the second substrate to define a plurality of discharge cells;

a phosphor layer formed in each of the discharge cells; and discharge sustain electrodes formed in a direction intersecting the address electrodes such that each of the discharge cells is in communication with a pair of the discharge sustain electrodes, each of the discharge sustain electrodes including extension sections that extend into the discharge cells such that a pair of opposing extension sections is formed in each of the discharge cells, wherein distal ends of each of the extension sections extended from at least one of each pair of the discharge sustain electrodes are formed having a concave section, and wherein at least a long gap and at least a short gap are formed together between the distal ends of the opposing extension sections.

14. The plasma display panel of claim 13, wherein the long gap is disposed between two short gaps.

15. The plasma display panel of claim 13, wherein each of the extension sections of the discharge sustain electrodes is formed such that a width in the direction intersecting the address electrodes is decreased as a distance from a center of the discharge cells is increased.

16. A plasma display panel, comprising:

first substrate and a second substrate opposing one another with a predetermined gap therebetween;

address electrodes formed on the second substrate;

barrier ribs mounted in the gap between the first substrate and the second substrate to define a plurality of discharge cells;

a phosphor layer formed in each of the discharge cells; and discharge sustain electrodes formed in a direction intersecting the address electrodes such that each of the discharge cells is in communication with a pair of the discharge sustain electrodes, each of the discharge sustain electrodes including a discharge sustain electrode extension section that extends into the discharge cell such that a pair of opposing discharge sustain electrode extension sections is formed in each of the discharge cells, a distal end of each discharge sustain electrode extension section having an enlarged discharge sustain electrode extension section with an enlarged section width being larger than a width of the discharge sustain electrode extension section distal from a communicating pair of discharge sustain electrodes of the discharge cell;

wherein among each pair of discharge sustain electrodes corresponding to a discharge cell, one of each pair is a scanning electrode that effects address discharge between address electrodes in a scan interval and an other of each pair is common electrode that effects display discharge between the common electrode and corresponding scanning electrode during a discharge sustain interval, and wherein each of the address electrodes have an enlarged address electrode section at areas corresponding to the enlarged discharge sustain electrode extension section of an opposing scanning electrodes.

17. The plasma display panel of claim 16, wherein the enlarged address electrode section has a substantially quadrilateral enlarged address electrode section of width W1, a linear address electrode section of width W3 connecting in enlarged address electrode section of a first discharge cell to an enlarged address electrode section of an adjacent second discharge cell sharing a common address electrode, and a tapered address electrode section of width W2 connecting the enlarged address electrode section to the linear address electrode section distal from a respective communicating pair of discharge cells sharing the common address electrode.

18. The plasma display panel of claim 17, wherein width W1>width W2>width W3.

19. The plasma display panel of claim 16, wherein at least a long gap and at least a short gap are formed together between the distal ends of the opposing discharge sustain electrode extension sections.

20. A plasma display panel comprising:

a first substrate and a second substrate opposing one another with a predetermined gap therebetween;

address electrodes formed on the second substrate;

barrier ribs mounted in the gap between the first substrate and the second substrate to define a plurality of discharge cells, the discharge cells having a discharge cell gas excited by an initiator discharge voltage;

a phosphor layer formed in each of the discharge cells; and discharge sustain electrodes formed in a direction intersecting the address electrodes such that each of the discharge cells is in communication with a pair of the discharge sustain electrodes, each of the discharge sustain electrodes including a discharge sustain electrode extension section that extends into the discharge cell such that a pair of opposing discharge sustain electrode extension sections is formed in each of the discharge cells with a gap between distal ends of the opposing discharge electrode extension sections;

wherein distal ends of each of the extension sections extended from at least one of each pair of the discharge sustain electrodes are formed having a concave section, wherein an amount of Xenon gas is established in a range from 10% to 60% of the discharge cell gas.

21. The plasma display panel of claim 20, wherein at least a long gap and at least a short gap are formed together between the distal ends of the opposing discharge sustain electrode extension sections.

22. The plasma display device of claim 20, wherein the initiator discharge voltage is in a range from 180V to 210V.

* * * * *

UNITED STATES PATENT AND TRADEMARK OFFICE

CERTIFICATE OF CORRECTION

PATENT NO. : 7,323,818 B2
APPLICATION NO. : 10/746541
DATED : January 29, 2008
INVENTOR(S) : Jae-Ik Kwon It is certified that error appears in the above-identified patent and that said Letters Patent is hereby corrected as shown below:

| | |
|---|---|
| Column 9, line 33, Claim 7 | Delete "phosphor layers",<br>Insert --a phosphor layer-- |
| Column 10, line 26, Claim 16 | Before "first",<br>Insert --a-- |
| Column 10, line 57, Claim 16 | Delete "have",<br>Insert --has-- |
| Column 10, line 60, Claim 16 | Delete "electrodes",<br>Insert --electrode-- |
| Column 10, line 64, Claim 17 | Delete "in",<br>Insert --an-- |

Signed and Sealed this

Twenty-fifth Day of November, 2008

JON W. DUDAS
*Director of the United States Patent and Trademark Office*